United States Patent [19]

Wood

[11] Patent Number: 4,964,565

[45] Date of Patent: Oct. 23, 1990

[54] MAILBOX SIGNALLING SYSTEM WHICH IS VISIBLE AT NIGHT AND IN DAYLIGHT

[76] Inventor: James Wood, 22122 U.S. Rte. 33, Marysville, Ohio 43040

[21] Appl. No.: 412,339

[22] Filed: Sep. 26, 1989

[51] Int. Cl.[5] ..... B65D 91/00

[52] U.S. Cl. ..... 232/35

[58] Field of Search ..... 232/34, 35, 37

[56] References Cited

U.S. PATENT DOCUMENTS

| | | | |
|---|---|---|---|
| D. 260,319 | 8/1981 | Kuntz . | |
| D. 278,469 | 4/1985 | Ross . | |
| 2,815,167 | 12/1957 | Bailey et al. | 232/35 |
| 3,498,255 | 3/1970 | Haeberle | 232/35 |
| 3,572,581 | 3/1971 | McLeod | 232/35 |
| 3,958,752 | 5/1976 | Pieszchala . | |
| 4,066,209 | 1/1978 | Brake | 232/35 |
| 4,492,335 | 6/1985 | Davis . | |
| 4,860,949 | 8/1989 | Moore | 232/35 |

FOREIGN PATENT DOCUMENTS

| | | |
|---|---|---|
| 171196 | 8/1934 | Fed. Rep. of Germany . |
| 453530 | 12/1949 | Italy . |

*Primary Examiner*—Robert W. Gibson, Jr.
*Attorney, Agent, or Firm*—T. M. Gernstein

[57] ABSTRACT

A signalling system is used in conjunction with a mailbox, a newpaper tube or the like to signal the arrival of mail, a newpaper or the like. The system is highly visible in bright sunlight and is also visible at night and includes a ball that is held in an upper location adjacent to the mailbox and is released as soon as the door is opened to drop downwardly. Two serially connected switches couple a light bulb to a power source, with one of the switches being manually operated and the other switch being operated when the ball drops into its lower position.

7 Claims, 3 Drawing Sheets

MAILBOX SIGNALLING SYSTEM WHICH IS VISIBLE AT NIGHT AND IN DAYLIGHT

TECHNICAL FIELD OF THE INVENTION

The present invention relates to the general art of signalling devices, and to the particular field of mailbox signalling devices.

BACKGROUND ART

Many homes in both rural and urban areas have a mailbox or newspaper tube that is located some distance form the home. this, of course, requires the resident to exit the home, walk to the mailbox or newspaper tube, retrieve the mail or newspaper and then return to the home.

While this can be a pleasant task, it can become onerous in inclimate weather. While this can be unpleasant for some, it can be extremely difficult for an elderly or handicapped person, especially in bad weather.

For this reason, the art has included several devices that are intended to visually indicate that mail, or a newspaper, has been placed in the mailbox or in the newspaper tube, see for example the devices disclosed in U.S. Pat. Nos. 3,958,752 and 4,492,335.

While devices such as these work well in daylight, if the ambient light is extremely low, due to a weather condition or the like, such devices are nearly useless. For example, many newspapers are delivered early in the morning, and in the winter, this delivery may occur while it is still dark. The homeowner may want to retrieve the paper but cannot determine if the paper has been delivered. A trip to the newspaper delivery tube early in the morning on a cold winter morning may be extremely difficult for a handicapped person. However, these devices are still useful for sunlit conditions and should not be totally ignored.

Therefore, there is a need for a mailbox or newspaper delivery tube signalling system that can be used in bright sunlight conditions as well as in low light, or no light conditions, such as at night.

OBJECTS OF THE INVENTION

It is a main object of the present invention to provide a versatile mailbox or newspaper delivery tube signalling system.

It is another object of the present invention to provide a versatile mailbox or newspaper delivery tube signalling system that can be used in bright sunlight conditions as well as in low, or no light, conditions, such as at night.

It is another object of the present invention to provide a versatile mailbox or newspaper delivery tube signalling system that can be used in bright sunlight conditions as well as in low, or no light, conditions, such as at night which can be easily changed from a sunlight-visible mode to a night-visible mode of operation.

It is another object of the present invention to provide a versatile mailbox or newspaper delivery tube signalling system that can be used in bright sunlight conditions as well as in low, or no light, conditions, such as at night which can be easily changed from a sunlight-visible mode to a night-visible mode of operation which will conserve a power source used in conjunction with the night-visible mode of operation.

SUMMARY OF THE INVENTION

These, and other, objects are achieved by a signalling system which includes a visual indicator that is highly visible in bright sunlight, as by having a highly polished reflective surface, or the like, and a light bulb which is activated by two serially connected switches. One of the switches is closed manually when night-mode operation is desired, and the others switch is closed automatically when the mailbox or newspaper tube door is opened, as for a delivery or the like.

In this manner, the system can be used in bright sunlight conditions while conserving the power source, yet is easily adapted for night-mode use. This makes the system extremely versatile.

DETAILED DESCRIPTION OF THE PREFERRED EMBODIMENT OF THE INVENTION

Figure 1:
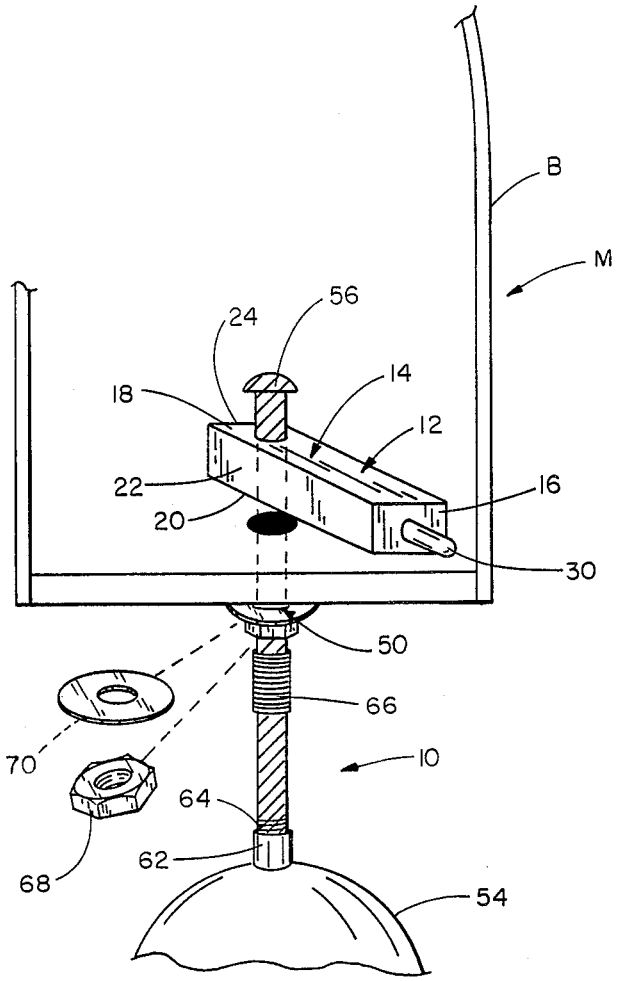
FIG. 1 is an indication of the signalling device in conjunction with a mailbox.

Shown in FIG. 1 is a signalling system 10 that is used in conjunction with a mailbox M to indicate that mail or some other item has probably been placed in the mailbox. It is noted that the present invention will be described in conjunction with a mailbox, but it is to be understood that the signalling system could also be used in conjunction with a newspaper tube or any other such device. The mailbox includes a hollow body B that includes two ends, one of which includes a door (not shown) hingeably connected to the body to open and close the body for the insertion of mail or the like into the mailbox.

The signalling system of the present invention is intended to indicate that the door of the mailbox has been opened, and in this manner indicate that mail has probably been inserted into the mailbox. The system is designed to be highly visible in bright sunlight or in dark conditions, with operation in a sunlight-visible mode being such as to conserve power used to operate the system in the night-visible mode whereby the system does not require much attention from a user, who may be disabled.

Figure 2:
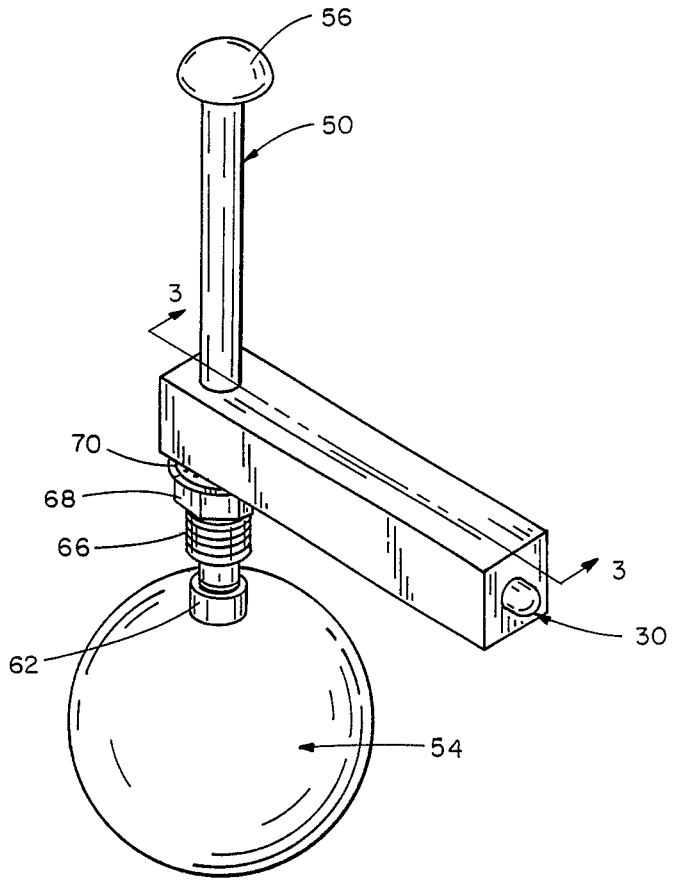
FIG. 2 is a perspective view of the signalling device of the present invention.
Figure 3:
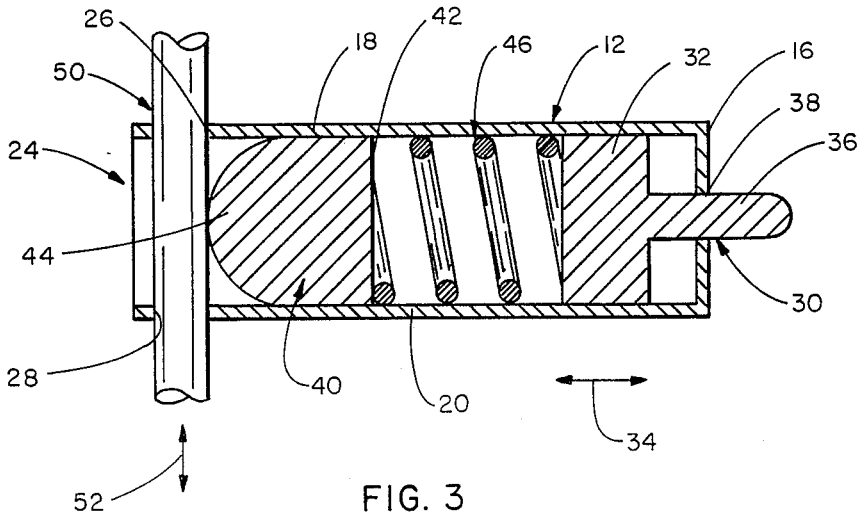
FIG. 3 is a cutaway elevational view taken along line 3—3 of FIG. 2 showing the locking mechanism used in the signalling system.
Figure 5:
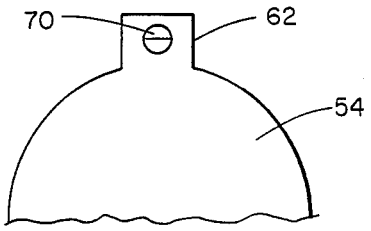
FIG. 5 is a sketch of the visual indicator including a light system used in a night mode of operation of the signalling system of the present invention.
Figure 6:
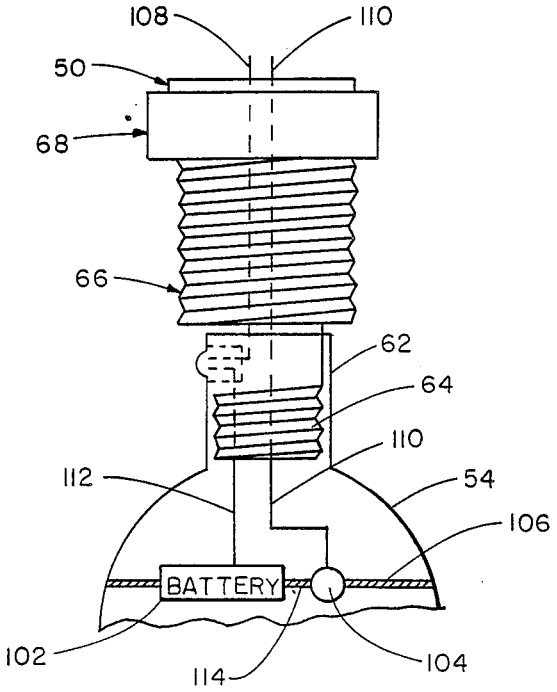
FIG. 6 is an elevational view of a portion of the night mode system of the signalling system.
Figure 8:
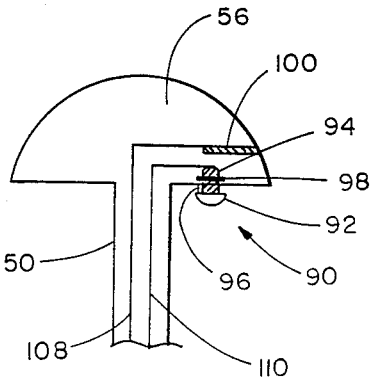
FIG. 8 illustrates a contact switch of the night mode system.
Figure 9:
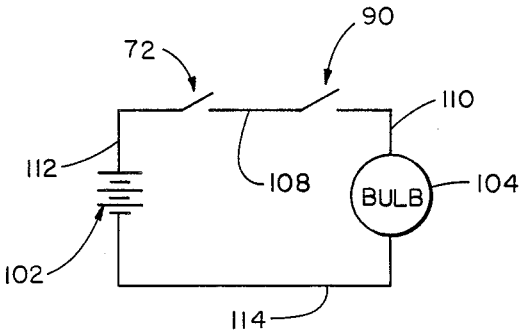
FIG. 9 is a schematic of the circuit used to control a light means of the night mode system.

The system 10 includes a door sensing means 12 that senses when the door of the mailbox has been opened and activates the signalling system. The door sensing means includes a hollow casing 14 mounted on the inside of the body B adjacent to the door of the mailbox and to have one end 16 thereof located to be in position to sense the presence of the mailbox door when such door is closed. The casing is best shown in FIGS. 2 and 3, and includes a top 18, a bottom 20 mounted on the mailbox, sides, such as side 22, and rear end 24 located remotely from the door. A passage, indicated in FIG. 2 at 26, is defined through the top 18, and a similar passage 28 is defined through the bottom of the casing to be aligned with the passage 26 and which serves a purpose to be discussed below.

As is best shown in FIG. 3, the sensing means includes a piston 30 having a cylindrical body 32 slidably mounted in the casing to move in the direction indicated by double-headed arrow 34 and a projection 36 that extends through a passage 38 defined in end 16 of the casing to contact the mailbox door when that door is closed and force the piston to move toward the rear end 24 of the casing as that door is forced completely closed.

The sensing means further includes a hemispherical detent element 40 slidably located inside the casing adjacent to the passages 26 and 28. The detent element includes a planar aft end 42 and an arcuate fore end 44. The detent element is adapted to slide in the casing in the direction of the double-headed arrow 34 as will be apparent from the ensuing discussion.

A spring 46 is positioned between and in contact with the detent element 40 and the piston 30 to mechanically and operably connect the piston to the detent to move that detent towards the casing rear end 24 when the door is being closed and to position that detent element in its rearmost location when the door is fully closed.

The system includes a signal means that includes a rod element 50, best shown in FIGS. 2 and 3, that is slidably connected to the casing adjacent to the passages 26 and 28 to move vertically up and down as indicated in FIG. 3 by the double-headed arrow 52. The detent element engages the rod as is seen in FIG. 3, for a purpose that will be evident from the ensuing discussion.

A visual indicator, such as hollow ball 54 is attached to a lower end of the rod to be located beneath the mailbox as seen in FIG. 1. The visual indicator is translucent and includes a highly polished reflective outer surface so that it will be readily visible in bright sunlight. The ball 54 is weighted, and can include special weights if suitable, to move the rod 50 downwardly when the rod element is released by the detent element, as will be discussed below.

As shown in FIG. 2, a stop element, such as hemispherical knob 56, is attached to the rod at its uppermost end. This stop element engages the casing top 14 when the rod has moved to its downwardmost position under the influence of the ball 54.

The spring element 46 has a spring force that is sufficient to engage the detent element against the rod with enough force to prevent the rod from dropping downwardly when the mailbox door is closed.

The rod will be released when the door is opened because the piston 30 will move to the right as viewed in FIG. 3 thereby releasing the pressure on the rod from the detent element sufficiently to permit that rod to drop downwardly. When the rod has moved downwardly far enough to make the ball 54 clearly visible, the knob 56 will engage the top of the casing and prevent further downward movement of the rod and ball. Even though the door is re-closed, the ball will remain in the down position thereby signalling the arrival of mail.

The rod is re-set after use by pulling it upwardly into the FIG. 2 position after operation, holding the projection 36 of the piston in, and closing the mailbox door. The spring force will be sufficient to delay the dropping of the rod for enough time to permit the door to be closed and force the piston into the rod holding position.

The ball 54 is easily visible in bright sunlight, so that during the daylight hours, the ball will be easily visible when it is in a down, mail arrival-indicating condition.

Figure 4:
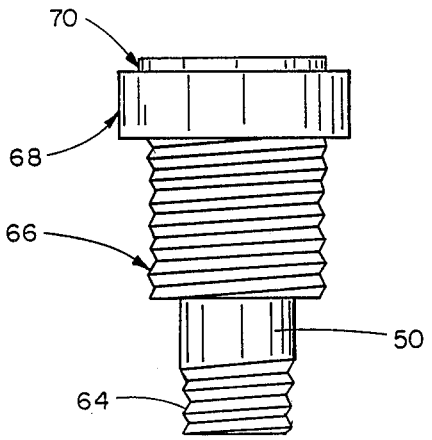
FIG. 4 is an elevational view of a coupling element used in the system of the present invention.

The ball is attached to the rod by a coupling mechanism 60, best shown in FIGS. 2 and 4 which includes an internally threaded collar 62 on the ball and an externally threaded distal end 64 on the rod which threadably engages the collar to attach the ball to the rod. The rod has further external threads 66 which co-operatively engage with a polygonal nut 68 to hold the rod in the desired cocked position. A washer 70 can be included in such coupling. The rod is pulled upwardly until the washer engages the bottom of the mailbox during the re-setting procedure.

As discussed above, the system 10 is intended for use in both a daylight mode and a night mode in which the ambient light conditions are low. Accordingly, the present system includes a light system. This light system is best shown in FIGS. 5–9, and attention is now directed to such figures.

Figure 7:
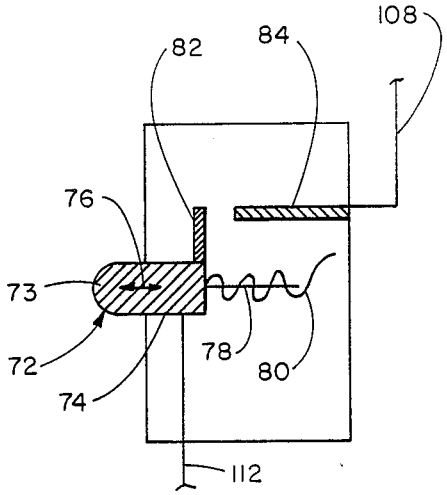
FIG. 7 illustrates a manually operated switch of the night mode system.

As shown, the night mode system includes an opening 70 in the collar 62 (the internal thread of the collar is seen through the opening 70) and a manually operated switch 72 that is mounted on the rod 50. The switch 72 includes a ball portion 73 and a body portion 74 and is mounted to move into and out of the rod as indicated in FIG. 7 by the double-headed arrow 76. A spring mounting rod 78 is attached to the body portion and extends across the rod, which is hollow at the location of the switch. A spring 80 is mounted on the rod 78 and has one end thereof engaged against the button and the other end thereof engaged against the rod to bias the button out of the rod. The button is forced into the rod by engagement with the inner surface of the collar and moves outwardly of the rod under the influence of the spring when the button is aligned with the hole 70 in the collar. Thus, the button can be operated by rotating the ball 54 to align the button with the hole 70 so the spring moves that button into the FIG. 7 outwardmost position, and is moved back into the rod by rotating the ball 54 until the button is engaged by the collar adjacent to the hole. The spring loading of the button is selected to permit this operation.

The button is electrically conductive and includes an electrically conductive projection 82 on the aft end thereof. The projection acts as one contact of the switch, and the switch includes a second contact 84 mounted on the rod to be engaged by the projection when the ball is forced rearwardly into the rod recess by the above-discussed action of rotating the collar 62.

The night mode system further includes a contact switch 90 that is operated when the knob 56 contacts the casing after the rod has been released by the detent element. The switch 90 includes a mushroom-shaped element having a head 92 and a body 94 that is slidably mounted on the knob. A spring 96 biases the head 94 downwardly, and a flange 98 serves as a stop to prevent the body 94 from becoming disconnected from the knob. The body is electrically conductive and serves as one contact of the switch, with a second contact being an electrically conductive projection 100 mounted in the knob adjacent to the body 94.

The night mode system further includes a power unit, such as battery 102 and a light bulb, 104 are mounted within the ball 54 on a spider-like mount 106.

The manually operated switch 72 and the contact switch are serially connected with each other and with the light bulb and power unit via electrical leads 108, 110, 112 and 114 respectively as shown in FIGS. 6–9. Due to the serial connection of the circuit elements, the manually operated switch must be closed before the contact switch will be able to complete the circuit when the rod moves downward into its downwardmost position with the knob in contact with the casing top 14. Thus, the user can elect the daylight mode of operation by simply not forcing the button of the switch 72 into the position to have the projection 82 contact the element 84. On the other hand, night mode operation is selected by rotating the ball 54 until the button of the switch 72 is moved into position to close the switch so that as soon as the rod moves downwardly to have the knob 56 contact the casing top, the switch 90 will close thereby completing the circuit shown in FIG. 9 and causing the light bulb to be activated.

It is understood that while certain forms of the present invention have been illustrated and described herein, it is not to be limited to the specific forms or arrangements of parts described and shown.

I claim:

1. A signalling system for use on a mailbox, newspaper tube or the like which has a hollow body with an open end and a door pivotally connected to the body to open and close that body, comprising:

(A) a door sensing means mounted on the hollow body adjacent to the door and including
  (1) a hollow casing having one end positioned closely adjacent to the open end and having a passage means defined therethrough adjacent to another end thereof,
  (2) a piston slidably mounted in said hollow casing adjacent to said one end and moving within said casing and having a door-contacting rod which extends out of said casing one end to contact the door when that door closes the body,
  (3) a detent element slidably mounted in said casing adjacent to said casing another end, and
  (4) a spring in said casing and having one end thereof engaging said piston and another end thereof engaging said detent element and biasing said detent element away from said piston; and (B) a signal means mounted on said hollow casing and including
  (1) a rod element slidably mounted on said hollow casing and sliding in said passage means in a vertical direction, said detent element engaging said rod element,
  (2) a visual indicator attached to said rod element and having a weight which is sufficient to move said rod element downwardly when the door is open,
  (3) a stop element on said rod element which engages said casing to prevent said rod element from disengaging from said casing,
  (4) said spring element having a spring force sufficient to force said detent element against said rod element with enough force to prevent said rod element from sliding under the influence of said visual indicator weight when the door is closed and said detent element engages said rod element under the influence of said piston and said spring, and
  (5) a light system in said visual indicator which includes
    (a) a power unit in said visual indicator,
    (b) a light bulb in said visual indicator,
    (c) a manually operated switch on said visual indicator, said manually operated switch element being closed by manipulation of said visual indicator,
    (d) a contact switch on said rod element, said contact switch being closed when said rod element has moved downwardly a prescribed distance after the door has been opened, and
    (e) lead means electrically connecting said light bulb to said power unit via said manually operated switch and said contact switch so that both of said switches must be closed to actuate said light bulb.

2. The signalling system defined in claim 1 wherein said visual indicator includes a hollow translucent ball.

3. The signalling system defined in claim 2 further including a mounting means in said ball mounting said power unit and said light bulb in said ball.

4. The signalling system defined in claim 3 further including a knob on said rod element with said contact switch being located in said knob.

5. The signalling system defined in claim 4 wherein said manually operated switch includes a button mounted on said rod element, and a spring biasing said button outwardly of said rod element.

6. The signalling system defined in claim 5 wherein said contact switch includes a mushroom-shaped button, a spring biasing said mushroom-shaped button downwardly and a stop element on said mushroom-shaped button.

7. The signalling system defined in claim 6 further including a highly polished reflective surface on said visual indicator.

* * * * *